United States Patent [19]

Kurematsu et al.

[11] Patent Number: 4,596,765

[45] Date of Patent: Jun. 24, 1986

[54] COMPOSITION OF A PHOTOGRAPHIC COLOR FORMING AGENT

[75] Inventors: Masayuki Kurematsu, Hachioji; Shigeharu Koboshi, Sagamihara, both of Japan

[73] Assignee: Konishiroku Photo Industry Co., Ltd., Japan

[21] Appl. No.: 677,851

[22] Filed: Dec. 4, 1984

[30] Foreign Application Priority Data

Dec. 5, 1983 [JP] Japan ..... 58-228552

[51] Int. Cl.[4] ..... G03C 5/24

[52] U.S. Cl. ..... 430/467; 430/469; 430/484; 430/488; 430/490; 430/491

[58] Field of Search ..... 430/467, 469, 491, 490, 430/488, 484

[56] References Cited

U.S. PATENT DOCUMENTS 3,746,544 7/1973 Heilmann ..... 430/467
3,839,045 10/1974 Brown ..... 430/467
3,994,730 11/1976 Frank et al. ..... 430/467
4,264,716 4/1981 Vincent et al. ..... 430/467
4,330,616 5/1982 Kurematsu et al. ..... 430/467

OTHER PUBLICATIONS

Research Disclosure Apr. 1981, #20405, p. 149.

*Primary Examiner*—Mary F. Downey
*Attorney, Agent, or Firm*—Finnegan, Henderson, Farabow, Garrett & Dunner

[57] ABSTRACT

A photographic color forming agent composition comprising an aromatic primary amine color developing agent and materials (A), (B), and (C). Material A is a compound having an aromatic ring bearing two hydroxy groups in the ortho positions thereof. Material B is a hydroxyalkylidene-diphosphonic acid metal ion chelating agent. Material C is at least one metal salt selected from the group consisting of the water-soluble metal salts of magnesium, bismuth, aluminum, zinc, barium, or zirconium. The metal salt is present in an amount in mols equivalent to or more than the amount in mols of metal ion chelating agents of B.

14 Claims, No Drawings

COMPOSITION OF A PHOTOGRAPHIC COLOR FORMING AGENT

BACKGROUND OF THE INVENTION

1. Field of the Invention

This invention relates to improvements in the compositions of a photographic color forming agent for processing a silver halide color photographic light-sensitive material and, more particularly to the compositions of a photographic color forming agent capable of preventing a harmful action caused by intermixed heavy metal ions.

2. Description of the Prior Art

Generally speaking, a silver halide color photographic light-sensitive material produces a dye image in a series of photographic processes fundamentally comprising a process of exposing imagewise to light, a color development process and a desilvering process.

In the above-mentioned color development process, a dye image with an image pattern is formed by a coupling reaction of the oxidants of a color developing agent with coexisting color couplers and at the same time reduced silver is produced. In the next desilvering process, the silver produced thereby is oxidized with a bleaching agent and is then changed into a soluble silver complex by a reaction with a fixer and is finally removed by dissolving it in washing water.

On the other hand, in an ordinary type of color developing liquids, a sulfite or a water-soluble salt of sulfite and hydroxylamine is added thereto to serve as a preserving agent so as to prevent the aromatic primary amine color developing agent from being oxidized.

It has already been known that, if only a sulfite is added to a developer independently, the satisfactory preservability is not always expected and more effective preservability can be obtained by adding hydroxylamine in the form of a water soluble salt. Besides the above, it has also been known that dihydroxyacetone, anilino ethanol, hydroxyl urea and the like can serve as such preserving agents, in place of the described hydroxylamine and a sulfite.

It is known that the preservation effects of these preserving agents are declined by the oxidation thereof caused by a catalysis with a very small amount of coexisting metal ions such as iron ions in particular, and that fog or stain is produced on a color photographic light-sensitive material because the described hydroxylamine salt is apt to produce ammonia and resultantly that the photographic characteristics are changed.

To prevent such unfavorable actions of the metal ions, the techniques of containing a variety of metal chelating agents have been proposed and put in practical application. For example, there may be given a technique disclosed in U.S. Pat. No. 3,839,045 wherein a hydroxyalkylidene-diphosphonic acid metal ion chelating agent and a lithium salt are used in combination; a technique disclosed in U.S. Pat. No. 3,746,544 wherein a polyhydroxy compound and an aminopolycarboxylic acid metal ion chelating agent are used in combination; a technique disclosed in U.S. Pat. No. 4,264,716, wherein a polyhydroxy compound and an aminopolyphosphonic acid metal ion chelating agent are used in combination; and the like. According to these techniques, it is possible to reduce the influences of a heavy metal ions such as iron ions mixed in a developing liquid.

From the results of the studies by the inventors of this invention, it was found that a photographic light-sensitive material caused fogs thereon and the photographic characteristics thereof became abnormal in which the shoulder in particular showed a hard contrast even if the described chelating agents were added, when a continuous process was carried out with an automatic processing machine. Particularly in both of a low replenishment process capable of economizing the quantity of replenishers used and a regenerative process capable of reusing an overflow both with the purposes of controlling pollutions and conserving natural resources, each process is a high-light of the modern photographic processes, it was recognized that the above-mentioned abnormality in the photographic characteristics is getting more serious as heavy metal ions are accumulated.

After the inventors devoted themselves to try to locate the causes of the findings, they finally located the following. Only the iron ions mixed in as an impurity have so far been discussed as the causal material of the above-mentioned phenomena, and it was however located that not only the described iron ions but the increase of copper ions mixed in also causes the described abnormality in photographic characteristics, and it was further found that any conventional chelating agent or any combination thereof can hardly be effective against copper ions and is also hard to make such copper ions harmless. To be concrete, a color developing liquid being popularly used contains copper ions of at least 0.1 ppm. and, ordinarily, nearly 0.3 ppm. Hydroxyalkylidene-diphosphonic acid metal ion chelating agent which is a conventional chelating agent used in a color developing liquid is not effective at all on copper ions, and a combination of a polyhydroxy compound and an aminopolycarboxylic acid metal ion chelating agent having not less than three carboxy groups disclosed in the aforementioned U.S. Pat. No. 3,746,544 cannot completely prevent any catalysis of copper ions. In addition to the above, there are some instances where a decomposition of hydroxylamine which is a preserving agent is accelerated thereby. Resultantly, the photographic characteristics of a processed photographic light-sensitive material will become abnormal, that is also a fault. A combination of a polyhydroxy compound and aminopolyphosphonic acid metal ion chlating agent has such a fault as is hard to put it in practical use because it precipitates with calcium ions, though it can cover heavy metals.

OBJECTS OF THE INVENTION

This invention was made for resolving the above-mentioned problems.

It is therefore an object of the invention to provide a composition of a photographic color forming agent which is so stable that a preserving agent contained in a color developing liquid is hard to be decomposed by the action of metal ions such as iron ions and copper ions in particular.

Another object of the invention is to provide a composition of a photographic color forming agent capable of preventing the photographic characteristics from causing any abnormality even when processing in the presence of heavy metal ions such as copper ions in particular.

A further object of the invention is to provide a composition of a photographic color forming agent capable of preparing a color developing liquid which is so stable that any precipitation or sludge cannot be preduced even in the presence of metal ions.

BRIEF SUMMARY OF THE INVENTION

The above-mentioned objects of the invention can be achieved by a composition of a photographic color forming agent containing an aromatic primary amine color developing agent and the following materials (A), (B) and (C):

(A) At least one kind of the compounds having an aromatic ring bearing two hydroxy groups in the ortho positions thereof, respectively, (B) At least one kind of hydroxyalkylidene-diphosphonic acid metal ion chelating agents, and (C) At least one kind of the metal salts selected from the group consisting of the water-soluble metal salts of magnesium, bismuth, aluminium, zinc, barium, or zirconium which are equivalent to or more than the metal ion chelating agents mentioned in the item (B) above.

DETAILED DESCRIPTION OF THE INVENTION

The antioxidation effect of the color developing liquids of the invention will not be obtained until a color developing liquid containing the above-mentioned compounds (A), (B) and (C) is used. If not in the presence of even one of the compounds, a satisfactory effect cannot be obtained. Accordingly, the above-mentioned objects of the invention are achieved in such a manner that hydroxyalkylidene-diphosphonic acid having a very strong iron ion covering power, a dihydroxybenzene having an excellent copper ion covering power and a specific water soluble metal salt are used in combination and a precipitation which may be produced with calcium at this time is prevented.

It is further desired to use the third metal ion chelating agent in combination therewith if in the presence of a large amount of calcium ions or magnesium ions. The preferable third metal ion chelating agents include, for example, iminodiacetic acid and the derivatives thereof not affecting the chelation of copper ions with dihydroxy compounds or the chelation of iron ions with hydroxyalkylidene-diphosphonic acid.

Next, the contents of the respective components in the composition of a color forming agent of the invention will be described.

The contents of the aromatic primary amine color developing agent is preferably in the range of from about 0.1 g to about 100 g per liter of the developing liquid, and more preferably in the range of from 1 g to 25 g. The contents of the compound having an aromatic ring bearing two hydroxy groups in the ortho positions, are preferably within the range of from 0.005 g to 20 g per liter of the developing liquid, and more preferably 0.01 g to 10 g and most preferably 0.02 g to 3 g. The contents of the hydroxyalkylidene-diphosphonic acid metal ion chelating agent are preferably within the range of from 0.01 g to 20 g per liter of the developing liquid and more preferably 0.1 g to 3 g and most preferably 0.2 g to 2 g. It is required that the number of the metal atoms to be contained in a water-soluble metal salt to be used in the invention should be equivalent in mol to or not less than the mol of hydroxyalkylidene-diphosphonic acid, and if this requirement can be satisfied, the chelating agent may be used in any quantity. The described metal salts may be used independently or in combination, provided that the whole quantity of the metal salts shall be equivalent in mol to or not less than that of the hydroxyalkylidene-diphosphonic acid.

The aromatic primary amine color developing agents to be used in the invention include, for example, an aminophenol and a paraphenylenediamine being used in an ordinary color photographic process. These compounds are commonly used in the form of a stable salt such as a hydrochloride or a sulfate, or the precursor thereof.

To be concrete, such aminophenols include, for example, -aminophenol, p-aminophenol, 5-amino-2-hydroxy-toluene, 2-amino-3-hydroxytoluene, 2-hydroxy-3-amino-1,4-dimethylbenzene and the like.

The useful paraphenylenediamines include N,N'-dialkyl-p-phenylenediamine derivatives such as a monohydrochloride of N,N'-diethyl-p-phenylenediamine, a 2-amino-5-diethylaminotoluene monohydrochloride, 4-amino-N-ethyl-N-(β-methane sulfonamide ethyl)-m-toluidine sesquisulfate monohydrate, 4-amino-3-methyl-N-ethyl-N-(β-hydroxyethyl)-aniline sulfate, 4-amino-3-(β-methylsulfonamidoethyl)-N,N'-diethylaniline hydrochloride, 4-amino-N,N'-diethyl-3-(N'-methyl-β-methylsulfonamide)aniline hydrochloride, the developers disclosed in U.S. Pat. Nos. 2,552,241 and 2,566,271, and the like. Inter alia, the particularly preferable compounds include a phenylenediamine of which the aromatic ring or the amino group is substituted by at least one alkylsulfonamide alkyl group, and a phenylenediamine of which the aromatic ring or the amino group is substituted by a hydroxyalkyl group. Besides the above, the particularly preferable compounds also include a paraphenylenediamine having the following Formula I and inter alia those having a water soluble group on the amino group thereof are preferred:

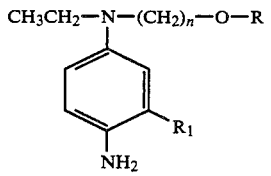

Formula [I]

Wherein, R represents an alkyl group having 1 to 4 carbon atoms; $R_1$ represents an alkyl group having 1 to 4 carbon atoms or an alkoxy group having 1 to 4 carbon atoms; and n is an integer of from 2 to 4.

The compouunds having Formula [I] include, for example, N-ethyl-N-methoxyethyl-3-methyl-p-phenylenediamine, N-ethyl-N-methoxybutyl-3-methyl-p-phenylenediamine, N-ethyl-N-ethoxyethyl-3-methyl-p-phenylenediamine, N-ethyl-N-methoxyethyl-3-n-propyl-p-phenylenediamine, N-ethyl-methoxyethyl-3-methoxy-p-phenylenediamine, N-ethyl-N-butoxyethyl-3-methyl-p-phenylenediamine, and the like.

"The compounds having an aromatic ring bearing two hydroxy groups in the ortho positions respectively" to be used in the invention include a compound having the other substituent than the two hydroxy groups which are in the ortho positions on the aromatic ring. For example, the compounds having the following Formulas [II] and [III] can preferably be given:

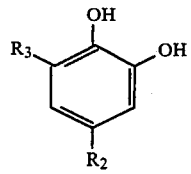

Formula [II]

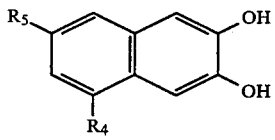

Formula [III]

Wherein, $R_2$, $R_3$, $R_4$ and $R_5$ each represent hydrogen, a halogen, sulfonic acid group, a substituted or unsubstituted alkyl group having 1 to 7 carbon atoms, $—OR_6$, $—COOR_7$,

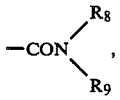

or a substituted or unsubstituted phenyl group, respectively in which $R_6$, $R_7$, $R_8$ and $R_9$ each represent hydrogen or an alkyl group having 1 to 18 carbon atoms.

To be concrete, these compounds include, for example, 1,2-dihydroxybenzene, 4-isopropyl-1,2-dihydroxybenzene, 1,2-dihydroxybenzene-3,5-disulfonic acid, 1,2,3-trihydroxybenzene, 1,2,3-trihydroxybenzene-5-carboxylic acid, 1,2,3-trihydroxybenzene-5-carboxymethyl ester, 1,2,3-trihydroxybenzene-5-carboxy-n-butyl ester, 5-t-butyl-1,2,3-trihydroxy benzene, 2,3-dihydroxynaphthalene-6-sulfonic acid, 2,3,8-trihydroxy naphthalene-6-sulfonic acid, and the like, and these compound shall not be limited to the examples given. Further, these compounds may also be used in the form of such an alkali metal salt as a sodium salt, a potassium salt and the like. Inter alia, the compound particularly preferable for the invention is 1,2-dihydroxybenzene-3,5-disulfonic acid.

The hydroxyalkylidene-diphosphonic acid metal ion chelating agents to be used in the invention include the compounds having the following Formula [IV] and the derivatives thereof:

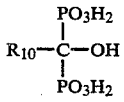

Formula [IV]

Wherein, $R_{10}$ represents an alkyl group having 1 to 5 carbon atoms.

To be concrete, the compounds having the above Formula [IV] include, for example, 1-hydroxyethylidene-1,1-diphosphonic acid, 1-hydroxypropylidene-1,1-diphosphonic acid, and the like, and they may be used independently or in combination. The particularly preferable compound for this purpose is 1-hydroxyethylidene-1,1-diphosphonic acid, and they may also be used in the form of an alkali metal salt such as a sodium salt or a potassium salt.

The water soluble salts to be used in the invention are the water soluble salts of magnesium, bismuth, aluminium, zinc, barium or zirconium, which are the compounds capable of supplying their metal ions to a processing liquid. These water soluble metal salts include an inorganic acid metal salt and an organic acid metal salt, and they also include a normal salt and an acid salt. Such compounds include, to be concrete, magnesium sulfate, magnesium nitrate, magnesium chloride, magnesium acetate, magnesium oxalate, magnesium citrate, bismuth sulfate, bismuth nitrate, bismuth acetate, bismuth chloride, aluminium sulfate, alum, sodium aluminate, aluminium acetate, zinc sulfate, zinc nitrate, zinc carbonate, barium chloride, barium sulfate, barium hydroxide, zirconium nitrate, zirconium sulfate and the like. These metal salts may be added to a color forming agent as they are or may also be added thereto together with a metal ion chelating agent in the form of a soluble complex salt. Among these metal salts, those preferably usable in the invention are a magnesium salt, zirconium salt, zinc salt or barium salt, and in particular the magnesium salts. In this invention, two or more kinds of these metal salts may be used in combination.

In the invention, the combination use of the above-mentioned two kinds of the metal ion chelating agents and a metal salt of the invention prevents a precipitation caused when a heavy metal ion and calcium ion co-oxist and a deterioration caused by an oxidation of a liquid. Especially when a large quantity of calcium ions coexists, the preservability can further be improved by using the third metal ion chelating agent as mentioned above.

As the third metal ion chelating agents, aminodicarboxylic acids such as iminodiacetic acid and iminodipropionic acid, and condensed phosphates such as triphosphoric acid and tetrapolyphosphoric acid, are preferably used. As the metal ion chelating agents particularly capable of improving the preservability, iminodiacetic acid or the derivatives thereof are preferable to use.

As the iminodiacetic acid or the derivatives thereof to serve as the third metal ion chelating agents preferably usable in the invention, iminodiacetic acid, N-ethyl iminodiacetic acid, N-methyl iminodiacetic acid, N-3,3-dimethylbutyl iminodiacetic acid, phenyl iminodiacetic acid, hydroxyethyl iminodiacetic acid, hydroxypropyl iminodiacetic acid, aminoethyl iminodiacetic acid, phosphonomethyl iminodiacetic acid, phoshonoethyl iminodiacetic acid, and the like are given as the examples, and it is the matter of course that the third metal ion chelating agents shall not be limited to the above-mentioned examples. The particularly preferable third metal ion chelating agents are hydroxyethyl iminodiacetic acid and the alkali metal salts thereof, including, for example, monosodium salts, disodium salts, monopotassium salts, dipotassium salts and the like. The quantity of these iminodiacetic acid and the derivatives thereof to be added in the composition of a color forming agent is preferably within the range of from about 0.2 g to 50 g per liter of developing liquid used and more preferably in the range of from 0.5 g to 20 g.

In the invention, the most preferable combination of the compounds of the invention is that comprising the developing agent of a paraphenylenediamine derivative having a water-soluble group on the amino group thereof, which is combined with 1,2-dihydroxybenzene-3,5-disulfonic acid, 1-hydroxyethylidene-1,1-diphosphoric acid, a magnesium salt and hydroxyethyl iminodiacetic acid.

In the invention, a suitable color development may be carried out when the temperature is preferably in the range of from 20° C. to 60° C. and preferably in from 30° C. to 45° C.

The preferable pH value of the composition of the color forming agents is preferably in the range of from about 7 to 14 and more preferably in the range of from 8 to 13.

Besides the above-mentioned constituents, the composition of the color forming agents of the invention may also be able to contain any well-known developing constituents. As the preserving agents among the above-mentioned developing constituents, the water-soluble salts of hydroxylamine such as the sulfate, chloride and phosphate thereof are given as the examples. As the alkali treating agents, buffering agents and the like, there are given sodium hydroxide, a silicate, sodium carbonate, potassium metaborate borax or the like which may be added independently or in combination. Further, from the necessity for preparing a color forming agent or for the purpose of increasing an ion strength, a variety of salts such as disodium hydrogenphosphate, sodium hydrogencarbonate, boric acid and the like may also be added.

As occasion demands, an inorganic or organic antifoggant may further be added. The typical compounds therefor include not only inorganic halide compounds such as potassium bromide, potassium iodide and the like but also 6-nitrobenzoimidazole described in U.S. Pat. No. 2,496,940 and 5-nitrobenzoimidazole described in U.S. Pat. Nos. 2,497,917 and 2,656,271. Besides the above, they also include, not to speak of o-phenylenediamine, mercaptobenzoimidazole, mercaptobenzoxazole, thiouracil, 5-methylbenzotriazole, a heterocyclic compound described in Japanese Patent Publication No. 41675/1971, and the like.

In addition to the above-mentioned various constituents, the development inhibiters disclosed in Japanese Patent Publication Nos. 19039/1971 and 6149/1970 and U.S. Pat. No. 3,295,976 and, if necessary, development accelerators, may also be added. The development accelerators include a variety of pyridinium compounds typified in U.S. Pat. Nos. 2,648,604 and 3,671,247 and Japanese Patent Publication No. 9503/1969; the other cationic compounds than the above; cationic dyes such as phenosafranine; neutral salts such as thallium nitrate; nonion compounds such as polyethylene glycol and the derivatives thereof described in U.S. Pat. Nos. 2,533,990, 2,531,832, 2,950,970, and 2,577,127, and Japanese Patent Publication No. 9504/1967 and a polythioether; organic solvents described in Japanese Patent Publication No. 9509/1967 and organic amines, ethanol amine, ethylenediamine, diethanol amine, triethanol amine and the like. The efficient development accelerators include benzyl alcohol and phenethyl alcohol each described in U.S. Pat. No. 2,304,925, and besides, acetylene glycol, methyl ethyl ketone, cyclohexane, a thioether, pyridine, ammonia, hydrazine, an amine, and the like. Further, a water softener such as polyphosphoric acid or a calcium or magnesium hiding agent may be used, provided that they do not check the effects of the invention. If occasion demands for improving the solubility of a developing agent, ethylene glycol, methyl cellosolve, methanol, acetone, dimethyl formamide, -cyclodextrin, and other compounds described in Japanese Pat. Nos. 33378/1972 and 9509/1969 may be used as an organic solvent for the purpose.

Still further, an auxiliary developer may also be used together with a developing agent. For the auxiliary developers, there are known, for example, N-methyl-p-aminophenol hexasulfate (Metol), 1-phenyl-3-pyrazolidone phenidone, N,N'-diethyl-p-aminophenol hydrochloride, N,N,N',N'-tetramethyl-p-phenylenediamine hydrochloride and the like. The ordinary contents thereof are preferably in the range of from 0.01 g to 1 g per liter. Besides the above, it is also possible to add, if necessary, a competing coupler, a fogging agent, a colored coupler, a development inhibitor releasing coupler (the so-called DIR coupler), a development inhibitor releasing compound, or the like.

The composition of the color forming agents of the invention can be applied to such a silver halide color photographic light-sensitive material as a color printing paper, a color negative film, a color positive film, a color reversal slide film, a color reversal cine film, a color reversal TV film, a color reversal printing paper and the like.

EXAMPLE

This invention will become more apparent in the detailed description and examples which follow, and it is to be understood that the invention shall not be limited to the specific embodiments.

EXAMPLE 1

The following experiments were tried by the use of the color printing paper developing liquid having the fundamental formula below:

| (Composition of Color Developing Liquid) | |
|---|---|
| Benzyl alcohol | 18.0 ml |
| Ethylene glycol | 20.0 ml |
| Hydroxylamine sulfate | 3.0 g |
| 4-amino-N—ethyl-N—(methane sulfonamide ethyl)-m-toluidine sesquisulfate monohydrate | 5.0 g |
| potassium sulfite (55% aqueous solution) | 8.0 ml |
| sodium carbonate | 20.0 g |
| Potassium carbonate | 10.0 g |
| Sodium bromide | 1.6 g |
| Potassium hydroxide | 1.0 g |
| Optical brightening agent (4,4'-diamino stilbene disulfonic acid derivative) | 1.0 g |
| Polyphosphoric acid | 3.0 g |
| 1,2-dihydroxybenzene-3,5-disulfonic acid-disodium salt | 0.3 g |
| Add water to make | 1 liter |

The metal ion chelating agents (i.e., the chelating agents) and an inorganic metal salts each listed in Table 1 were added to the above-mentioned color developing liquid and calcium chloride was further added thereto in the amount of 0.5 g per liter to prepare the Sample Nos. (1) to (11), respectively. Each of the sample was added with iron ions of 3 mg per liter (in the form of $FeCl_3$) and was then added with copper ions (in the form of $CuCl_2$) as heavy metal ions so that the copper ions can be 3 mg per liter. The pH values of the color developing liquids were adjusted to 10.1 respectively with sulfuric acid or potassium hydroxide. Then, the following experiments were tried:

Experiment 1

Each of the above-mentioned color developing liquid Sample Nos. (1) to (11) was put in a tightly sealed polyethylene container and was preserved for two weeks at 50° C. After the preservation, hydroxylamine that was the preserving agent was subjected to a quantitative analysis in an ordinary manner. Table 1 shows the results of the quantitative analyses in terms of the decomposition rate (i.e. the decreasing rate).

Experiment 2

Further, the following color printing paper was prepared with which a color development process was carried out.

The color printing paper was prepared in such a manner that the surface of the support was coated with a polyethylene layer containing an anatase-type titanium dioxide serving as a white pigment and a pretreatment was applied onto the support with a corona discharge, and then the following layers were coated thereon in order:

1st layer:

A silver chlorobromide photographic emulsion containing 5 mol % of silver chloride was optically sensitized with anhydro-5-methyl-5'-methoxy-3,3'-di(3-sulfopropyl)selenacyanine hydroxide. To this was added with 2,5-di-t-butylhyroquinone and a protect dispersion liquid of α-[4-(1-benzyl-2-phenyl-3,5-dioxo-1,2,4-triazolizyl)-α-pivalyl-2-chloro-5-[γ-(2,4-di-t-amylphenoxy)butylamide] acetanilide as a yellow coupler. The emulsion thus prepared was coated on the support so that the amount of silver can be 0.35 g per sq. meter.

2nd layer:

This layer was coated as an intermediate layer comprising a gelatin solution added with a protective dispersion liquid containing di-t-octyl hydroquinone and the mixture of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorbenzotriazole and 2-(2'-hydroxy-3',5'-di-t-butylphenyl)-5-chlorbenzotriazole as an ultraviolet absorbing agent.

3rd layer:

A silver chlorobromide photographic emulsion containing 15 mol % of silver chloride was optically sensitized with anhydro-9-ethyl-5,5'-diphenyl-3,3'-di(3-sulfopropyl)oxacarbocyanine hydroxide. To this was added with a protective dispersion liquid containing 2,5-di-t-butyl hydroquinone, 2,2,4-trimethyl-6-lauryloxy-7-t-octyl cumarone and 1-(2,4,6-trichlorophenyl)-3-(2-chloro-5-octadecenyl succinimidanilino)-5-pyrazolone as a magenta coupler. The emulsion thus prepared was coated on the above-mentioned second layer so that the amount of silver can be 0.4 g per sq. meter.

4th layer:

The same liquid as that of the 2nd layer was coated as an interlayer on the 3rd layer.

5th layer:

A silver chlorobromide photographic emulsion containing 15 mol % of silver chloride was optically sensitized with anhydro-2-[3-ethyl-5-(1-ethyl-4(1H)-quinolylidene)ethylidene-4-oxo-thiazolidine-2-iridin]-methyl-3-(3-sulfopropyl)benzoxazolium hydroxide. To this was added jointly with a dispersion liquid in which 2,5-di-t-butyl hydroquinone and 4-chloro-2-(pentafluorobenzamide)-5-{α-(2,4-di-t-pentylphenoxy)-isovaleramide}phenol as a cyan coupler were dispersed in dibutyl phthalate, and further another dispersion liquid in which 2-(4-butane sulfonyl phenyl ureide)-5-{α-(2,4-di-t-pentyl phenoxy)butanamide)phenol was dispersed in dibutyl phthalate. The emulsion thus prepared was coated on the 4th layer so that the amount of silver can be 0.27 g per sq. meter.

6th layer:

A gelatin solution was coated on the 5th layer so as to serve as a protective layer.

Silver halide photographic emulsions used in each of the above-mentioned light-sensitive layers were prepared in the process described in Japanese Patent Examined Publication No. 7772/1971. They were chemically sensitized with sodium thiasulfate. To these were then added with 4-hydroxy-6-methyl-1,3,3a,7-tetrazaindene so as to serve as a stabilizer. The coating liquid for every layer was also added with saponin as an auxiliary agent for coating and bis(vinyl sulfonyl methyl) ether as a hardener, respectively. Thus prepared color printing paper was exposed to white light through a step-wedge and was then color-developed in the steps listed below by the use of Samples (1) through (11) of the developers each already allowed to stand for one to two weeks on the conditions described in Experiment 1:

| Processing step | Temperature (°C.) | Time (min) |
|---|---|---|
| color developing | 38 | 3½ |
| Bleaching/fixing | 33 | 1½ |
| Washing | 30 | 3 |
| Drying | 75–85 | |

The compositions of the bleaching/fixing solution and the stabilizer were as follows:

| Bleaching/fixing solution | |
|---|---|
| Ferric ammonium diethylenetriamine pentacetate | 70 g |
| Ammonium sulfite (50% solution) | 30 ml |
| Ammonium thiosulfate (70% solution) | 140 ml |
| Aqueous ammonia (28% solution) | 30 ml |
| Diethylenetriamine pentacetic acid | 7 g |
| Nickelic nitrilotriacetate | 10 g |
| Add water to make | 1 liter |

Sensitometric curves of Samples (1) through (11) processed by taking the above-mentioned steps were made out by measuring each of the reflection of yellow, magenta and cyan with a SAKURA Photographic densitometer, Model PDA-65 (mfd. by Konishiroku Photo Ind. Co., Ltd., Japan). Table 1 shows the computation of the respective reflection density {i.e. the gamma values (γ)} from 1.3 to 1.8.

Experiment 3

Each of the developer samples (1) through (11) was stored at 10° C. for six weeks, and then the visual inspection thereof was made on how any sludge produced during the storage. The results thereof are shown in Table 1 below.

TABLE 1

| Sample No. | | Names of Heavy Metal Ions Mixed-in & the density thereof | Metal Ion Chelate Name | Metal Ion Chelate Density (g/l) | Metal Salt Name | Metal Salt Density (g/l) | Decomposition Ratio of Hydroxylamine (%) | Precipitated Stale after stored for 6 wks. at 10° C. | Photographic Characteristics after storing (γ) Blue Density γ | Green Density γ | Red Density γ |
|---|---|---|---|---|---|---|---|---|---|---|---|
| 1 | Com- | 3 ppm ea. of | Nil | — | Nil | — | 58.1 | Nil | 3.68 | 4.86 | 5.23 |

TABLE 1-continued

| Sample No. | | Names of Heavy Metal Ions Mixed-in & the density thereof | Metal Ion Chelate Name | Metal Ion Chelate Density (g/l) | Metal Salt Name | Metal Salt Density (g/l) | Decomposition Ratio of Hydroxylamine (%) | Precipitated Stale after stored for 6 wks. at 10° C. | Photographic Characteristics after storing (γ) Blue Density γ | Green Density γ | Red Density γ |
|---|---|---|---|---|---|---|---|---|---|---|---|
| | parison | iron ion & copper ion | | | | | | | | | |
| 2 | Comparison | 3 ppm ea. of iron ion & copper ion | 1-hydroxyethylidene-1,1-diphosphonic acid | 2.0 | Lithium Chloride (Anhydrous) | 2.0 | 33.9 | Precipitated | 3.61 | 3.98 | 4.68 |
| 3 | Comparison | 3 ppm ea. of iron ion & copper ion | 1-hydroxyethylidene-1,1-diphosphonic acid | 2.0 | Potassium Chloride (Anhydrous) | 2.0 | 58.4 | Abundantly Precipitated | 3.67 | 5.11 | 5.16 |
| 4 | Invention | 3 ppm ea. of iron ion & copper ion | 1-hydroxyethylidene-1,1-diphosphonic acid | 2.0 | Magnesium Chloride Hexahydra | 2.0 | 14.6 | Nil | 3.34 | 3.65 | 4.08 |
| 5 | Invention | 3 ppm ea. of iron ion & copper ion | 1-hydroxyethylidene-1,1-diphosphonic acid | 2.0 | Magnesium hydroxyethyl iminodiacetate | 2.5 | 15.1 | Nil | 3.28 | 3.54 | 3.98 |
| 6 | Invention | 3 ppm ea. of iron ion & copper ion | 1-hydroxyethylidene-1,1-diphosphonic acid | 2.0 | Potassium Sulfate Aluminum Dodecahydrate | 5.0 | 17.6 | Nil | 3.41 | 3.67 | 4.02 |
| 7 | Invention | 3 ppm ea. of iron ion & copper ion | 1-hydroxyethylidene-1,1-diphosphonic acid | 2.0 | Zinc Sulfate Heptahydrate | 3.0 | 18.1 | Nil | 3.42 | 3.69 | 4.02 |
| 8 | Invention | 3 ppm ea. of iron ion & copper ion | 1-hydroxyethylidene-1,1-diphosphonic acid | 2.0 | Barium Sulfate (Anhydrous) | 3.0 | 16.4 | Nil | 3.21 | 3.54 | 4.12 |
| 9 | Invention | 3 ppm ea. of iron ion & copper ion | 1-hydroxyethylidene-1,1-diphosphonic acid | 2.0 | Zirconium Sulfate Tetrahydrate | 4.0 | 17.5 | Nil | 3.51 | 3.59 | 4.04 |
| 10 | Invention | 3 ppm ea. of iron ion & copper ion | 1-hydroxyethylidene-1,1-diphosphonic acid | 2.0 | Magnesium Acetate Tetrahydrate | 2.5 | 14.8 | Nil | 3.57 | 3.63 | 3.97 |
| 11 | Invention | 3 ppm ea. of iron ion & copper ion | 1-hydroxyethylidene-1,1-diphosphonic acid | 2.0 | Bismath Chloride | 2.0 | 14.8 | Nil | 3.30 | 3.50 | 3.99 |

As is obvious from the results shown in Table 1 above, it can be understood that, in a nearly practical system similar to the ordinary running solution in which iron ions and copper ions are simultaneously mixed in and metal ions such as calcium ions are further mixed in or added, the decomposition and precipitation of hydroxylamine cannot be inhibited with only the use of an alkylidene-disulfonic acid chelating agent such as 1-hydroxyethylidene-disulfonic acid which is so-called an excellent chelating agent for iron ions or a compound having two hydroxy groups in each of the ortho positions of the aromatic ring thereof.

It is further understood that no effect can be enjoyed even if the above-mentioned metal ion chelating agents are used in combination with any other metal ions such as a lithium salt and a potassium salt than those of the invention.

In contrast therewith, when the above-mentioned alkylidene-disulfonic acid, the dihydroxy compounds positioning in each of the ortho positions and a metal salt of the invention are used in combination, and even if there is a precipitation of a heavy metal ion, calcium or the like, it is found that the decomposition of hydroxylamine can be decreased and the precipitation caused in a cold storage can be prevented and further no abnormality is found in the photographic characteristics of the samples and still further the density gamma values in blue, green and red are closer to the reference values, 3.24 in blue density, 3.51 in green density and 3.94 in red density, respectively. The same experiments as this example were tried by making use of cobalt, manganese, cerium, mercury, antimony, thallium, rubidium and the like as the metal ions, respectively and the effects of the invention were not obtainable.

Comparative Example 1

A developing liquid was prepared similar to the preparation made in Example 1, except that 1,2-dihydroxybenzene-3,5-disulfonic acid-disodium salt was not mixed in the composition of the color developing liquid. To this developing liquid was added with the metal ion chelating agent and the inorganic metal salt listed in Sample No. 4 of Table 1 and was further added with calcium of 0.5 g per liter.

To the developing liquid was added with iron ions of 3 mg per liter in the form of $FeCl_3$ and was further mixed in with copper ions in the form of $CuCl_2$ so that the copper ions can be 3 mg per liter.

The pH value of the color developing liquid is adjusted with sulfuric acid or potassium hydroxide so as to be 10.1, and the same experiment as Example 1 was tried.

As the result thereof, no precipitation was observed in the cold storage, however, the very unsatisfactory results were obtained, i.e., the decomposition ratio of hydroxylamine was not lower than 60%, and among the photographic characteristics, the gamma values of blue, green and red were higher than those obtained in Sample No. 1.

Example 2

Each of Samples No. (4') through No. (9') were prepared respectively in the manner that the color developing liquid Samples No. 4 through No. 9 were further added with hydroxyethyl imino diacetic acid of 4 g per liter as a third metal ion chelating agent, and the same preservation tests as those tried in Experiment 1 were tried. After then, each hydroxylamine as the preservative was measured quantitatively and each of the ratios of the decomposition thereof (i.e., the decrease ratios) was obtained.

The results are shown in Table 2, as compared with those of Example 1.

As is obvious from Table 2, the every color developing liquid Sample, No. (4') through (9'), showed the remarkable effects of the combination use as compared with Samples No. (4) through No. (9), because the every decomposition ratio (i.e., the decrease ratio) was lowered.

TABLE 2

| Example-1 | | Example-2 | |
|---|---|---|---|
| Sample No. | Decomposition ratio (%) | Sample No. | Decomposition ratio (%) |
| 4 | 14.6 | 4' | 9.6 |
| 5 | 15.1 | 5' | 10.2 |
| 6 | 17.6 | 6' | 11.4 |
| 7 | 18.1 | 7' | 12.6 |
| 8 | 16.4 | 8' | 13.3 |
| 9 | 17.5 | 9' | 13.8 |

What is claimed is:

1. A photographic color forming agent composition comprising an aromatic primary amine color developing agent and the following materials (A), (B), and (C):

(A) At least one compound having an aromatic ring bearing two hydroxy groups in the ortho positions thereof, (B) At least one hydroxyalkylidene-diphosphonic acid metal ion chelating agent, and (C) At least one metal salt selected from the group consisting of the water-soluble metal salts of magnesium, bismuth, aluminium, zinc, barium, or zirconium, said metal salt being present in an amount in mols equivalent to or more than the amount in mols of metal ion chelating agents of (B).

2. A photographic color forming agent composition as claimed in claim 1, wherein said composition further contains iminodiacetic acid or the derivative thereof.

3. A photographic color forming agent composition as claimed in claim 1, wherein said aromatic primary amine color developing agent has the following Formula [II];

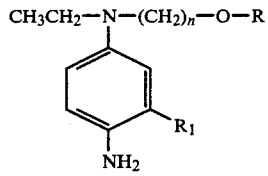

Formula [I]

wherein, R represents an alkyl group having 1 to 4 carbon atoms; $R_1$ represents an alkyl group having 1 to 4 carbon atoms or an alkoxy group having 1 to 4 carbon atoms; and n is an integer of from 2 to 4.

4. A photographic color forming agent composition as claimed in claim 1, wherein said compound having an aromatic ring bearing two hydroxy groups in the ortho positions thereof, respectively has either one of the following Formula [II] and [III];

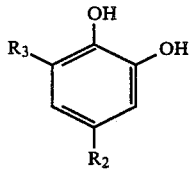

Formula [II]

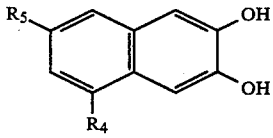

Formula [III]

wherein, $R_2$, $R_3$, $R_4$ and $R_5$ each represent hydrogen, a halogen, sulfonic acid group, a substituted or unsubstituted alkyl group having 1 to 7 carbon atoms, $—OR_6$, $—COOR_7$,

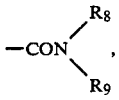

or a substituted or unsubstituted phenyl group, respectively; and $R_6$, $R_7$, $R_8$ and $R_9$ each represent hydrogen or an alkyl group having 1 to 18 carbon atoms.

5. A photographic color forming agent composition as claimed in claim 1, wherein said hydroxy alkylidene-diphosphonic acid metal ion chelating agent has the following Formula [IV];

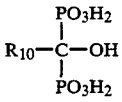

Formula [IV]

wherein, $R_{10}$ represents an alkyl group having 1 to 5 carbon atoms.

6. A photographic color forming agent composition as claimed in claim 1, wherein the contents of said aromatic primary amine color developing agent are from 0.1 g to 100 g per liter.

7. A photographic color forming agent composition as claimed in claim 1, wherein the contents of said comound having the aromatic ring bearing two hydroxy groups in the ortho positions thereof respectively are in the range of from 0.005 g to 20 g per liter.

8. A photographic color forming agent composition as claimed in claim 1, wherein the contents of said hydroxyalkylidene-diphosphonic acid metal ion chelating agent are in the range of from 0.01 g to 20 g per liter.

9. A photographic color forming agent composition as claimed in claim 1, wherein said water-soluble metal salt is a salt selected from the group consisting of magnesium salts, zirconium salts, zinc salts and barium salts.

10. A photographic color forming agent composition as claimed in claim 1, wherein said aromatic primary amine color developing agent has a water soluble group on the amino group thereof.

11. A photographic color forming agent composition as claimed in claim 1, wherein said aromatic primary amine color developing agent is of a phenylenediamine of which at least one hydrogen atom of the aromatic ring or the amino group thereof is substituted by alkylsulfonamide alkyl group.

12. A photographic color forming agent composition as claimed in claim 1, wherein said aromatic primary amine color developing agent is of a phenylenediamine of which at least one hydrogen atom of the aromatic ring or amino group thereof is substituted by hydroxyalkyl group.

13. A photographic color forming agent composition as claimed in claim 1, wherein said composition comprises an developing agent of a paraphenylene diamine derivative having a water soluble group on the amino group thereof, 1,2-dihydroxybenzene-3,5-disulfonic acid, 1-hydroxyethylidene-1,1-diphosphonic acid, a magnesium salt and hydroxyethyl iminodiacetic acid.

14. A photographic color forming agent composition as claimed in claim 1, wherein said metal salts are metal complex salt.

* * * * *